US012209756B2

(12) United States Patent
Kim et al.

(10) Patent No.: US 12,209,756 B2
(45) Date of Patent: Jan. 28, 2025

(54) COOKING APPLIANCE

(71) Applicant: LG ELECTRONICS INC., Seoul (KR)

(72) Inventors: Youmin Kim, Seoul (KR); Taehong Yeo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 557 days.

(21) Appl. No.: 17/494,519

(22) Filed: Oct. 5, 2021

(65) Prior Publication Data

US 2022/0128240 A1 Apr. 28, 2022

(30) Foreign Application Priority Data

Oct. 26, 2020 (KR) ..... 10-2020-0139220

(51) Int. Cl.
*F24C 7/08* (2006.01)
*F24C 15/08* (2006.01)
*F24C 15/34* (2006.01)

(52) U.S. Cl.
CPC ..... *F24C 7/082* (2013.01); *F24C 15/08* (2013.01); *F24C 15/34* (2013.01)

(58) Field of Classification Search
CPC ... F24C 7/085; F24C 15/2021; A47J 37/0623; A47J 2202/00; A47J 37/1266; H01R 13/73; H01R 13/40; H01R 4/302; H01R 9/16; H01R 12/67; H01R 13/424; H01R 13/5208; F23N 2900/05005; G01K 13/00
USPC ..... 126/273 R; 431/13; 374/208
See application file for complete search history.

(56) References Cited

U.S. PATENT DOCUMENTS 4,967,049 A * 10/1990 Kaneshiro ..... G01K 7/023 374/149
2006/0222050 A1* 10/2006 Byrne ..... G01K 1/14 374/149

FOREIGN PATENT DOCUMENTS

CN 107884029 B * 9/2020 ..... A47J 27/56

* cited by examiner

*Primary Examiner* — Jason Lau
(74) *Attorney, Agent, or Firm* — Bryan Cave Leighton Paisner LLP

(57) ABSTRACT

A cooking appliance including a cavity for a cooking space, a socket passing through the cavity and at least partially disposed in the cooking space, and a probe detachably connected to the socket and configured to measure a temperature of the cooking space or a food item stored therein, wherein the socket includes an insulating part configured to electrically insulate a first cable from a second cable and onto which a second terminal part provided to the second cable is mounted, a first connector having a coupling projection for coupling with the insulating part, and wherein the insulating part is disposed in a portion of the hollow hole part, and the first terminal part provided to the first cable is electrically connected to an outside of the first connector, and a second connector disposed in the hollow hole part and electrically connected to the second terminal part.

19 Claims, 14 Drawing Sheets

COOKING APPLIANCE

CROSS-REFERENCE TO RELATED APPLICATION

This application claims priority to and the benefit of Korean Patent Application No. 10-2020-0139220, filed on Oct. 26, 2020, which is hereby incorporated by reference as if fully set forth herein.

TECHNICAL FIELD

This disclosure describes a cooking appliance, and in particular, a cooking appliance having a device capable of measuring a temperature of a cooking space.

BACKGROUND

Details in the background section do not constitute the related art but are given only as background information concerning the subject matter of the present disclosure.

Cooking appliances generally fall into different categories, based on a heat source or a type, and the sort of a fuel. For example, cooking appliances may be categorized as either an open cooking appliance in which food is placed in an open space, or a sealed cooking appliance in which food is placed in a closed space. The sealed cooking appliance may include an oven, a microwave oven, or the like. The open cooking appliance may include a cooktop, a hob, or the like.

For example, in the sealed cooking appliance, a space, in which a food item is placed, is shielded, and the shielded space is heated to cook the food item. The sealed cooking appliance is provided with a cooking space in which a food item is placed and which is shielded when the food item is cooked. In the cooking space, a food item is actually cooked. A heat source is disposed inside or outside of the cooking space to heat the cooking space.

The sealed cooking appliance may include a door that selectively opens and closes the cooking space in a rotatable manner. The door may be installed on a main body in a rotatable manner with a door hinge. The door hinge may be disposed between the main body provided with the cooking space therein and the door. The door may rotate around a portion where the door is coupled to the main body to selectively open and close the cooking space.

A heat source is disposed in an inner space of the cooking space that is opened and closed by the door, to heat the cooking space. The heat source may include a gas burner, an electric heater, or the like.

In one example of the present disclosure, a food item is put into the cooking space of the cooking appliance and cooked in a high temperature atmosphere. In this example, when the temperature of the food item is determined, the temperature of the cooking space or heating time may be adjusted based on the temperature of the food item.

Accordingly, the cooking appliance may be provided with a device for measuring the temperature of the cooking space or the temperature of a food item stored in the cooking space. The device for measuring a temperature may be detachably disposed in the cooking space to allow a user to readily determine the temperature of the cooking space or the food item.

The device for measuring a temperature may operate electrically. In this example, when an electrical short occurs among components of the device for measuring a temperature, an error may occur in measurement of a temperature, a risk may be imposed on the user, and damage may be caused to the cooking appliance.

Thus, there is a growing need to solve the problem.

SUMMARY

According to an embodiment of the present disclosure, a cooking appliance is detachably provided with a probe to measure a temperature of a cooking space or a food item stored in the cooking space.

According to an embodiment of the present disclosure, a cooking appliance including a probe is provided. The probe includes a structure that is configured to suppress an electrical short.

According to an embodiment of the present disclosure, a cooking appliance having a structure that is configured to suppress an electrical short between cables connected to a socket from the outside is provided. The electrical short may be caused as a result of a rotation of a terminal part when the socket is detachably connected to the probe during assembly of the cooking appliance.

According to an embodiment of the present disclosure, a cooking appliance may include a temperature measuring device provided with a socket disposed at a cavity forming a cooking space of the cooking appliance, and a probe detachably connected to the socket.

The socket may be electrically connected to a control device, or the like, and may include a first connector and a second connector, onto which a first cable and a second cable forming different power lines are respectively mounted, and an insulating part electrically connecting the first connector and the second connector.

The insulating part may be provided with a pair of stoppers, protruding from both (or opposite) sides thereof, in a portion onto which the second connector is mounted. The stopper may suppress an electrical short in the temperature measuring device by suppressing rotation of a second terminal part provided to the second cable.

The insulating part may have a depression in the portion onto which the second connector is mounted. Portions of outer lines of the depression of the insulating part may be disposed not to meet each other and may suppress rotation of the second terminal part. With this structure, rotation of the second terminal part may be suppressed with respect to the insulating part, and an electrical short in the temperature measuring device may be suppressed.

According to an embodiment of the present disclosure, a cooking appliance may include a cavity provided therein with a cooking space, a socket passing through the cavity and disposed in the cooking space at least partially, and a probe detachably connected to the socket and configured to measure a temperature of the cooking space or a food item stored in the cooking space.

The socket may include an insulating part configured to electrically insulate a first cable from a second cable, a second terminal part provided to the second cable is mounted on the insulating part, a first connector having a hollow hole part and a coupling projection for coupling with the insulating part at one end thereof, wherein the insulating part is disposed in a portion of the hollow hole part, and wherein a first terminal part provided to the first cable is electrically connected to outside of the first connector, and a second connector disposed in the hollow hole part and electrically connected to the second terminal part.

The insulating part may include an inserting part formed into a cylindrical shape (or any other suitable shape) having a hollow hole. The inserting part may be inserted into the hollow hole part of the first connector, and at least a portion of the second connector is disposed in the hollow hole part. A terminal mounting part having a circular outer circumferential surface is configured to close one side of the inserting part, and the second terminal part is mounted on the terminal mounting part.

The terminal mounting part may include a terminal mounting groove having a depression, and the second terminal part is mounted onto the depression. A pair of stoppers protruding from both (or opposite) sides of the terminal mounting groove is configured to suppress rotation of the second terminal part.

The terminal mounting part may further include a pair of coupling grooves. A portion of an outer circumferential surface of each of the pair of coupling grooves is depressed, and the coupling projection of the first connector is coupled to the coupling projection.

The second terminal part may include a third terminal coupled to the second cable, and a fourth terminal bent from the third terminal having a first through hole.

The terminal mounting groove may be provided with a rotation suppressing part that is formed in a way that the outer lines (e.g., perimeter) of the depressed portion are disposed in directions that cross each other to suppress rotation of the fourth terminal, and the fourth terminal may have a portion in which outer lines (or perimeter) are disposed in directions that cross each other to have a shape corresponding to the shape of the rotation suppressing part.

The insulating part may further include a second through hole passing through the terminal mounting part, and formed at a position corresponding to the first through hole when the fourth terminal is mounted onto the terminal mounting part.

The probe may include a connecting jack detachably inserted into the first connector, a third cable comprising one end being electrically connected to the connecting jack, and a temperature measuring part electrically connected to the other end of the third cable and configured to measure a temperature of the cooking space or a food item stored in the cooking space.

The second connector may include a first cell coupled to the insulating part and including a third through hole provided to correspond to the second through hole, a second cell bent and extended from the first cell, and a third cell extended from the second cell, the third cell having a groove shape and contacting the connecting jack of the probe.

The socket may further include a coupling tool inserted into the first through hole, the second through hole and the third through hole to couple the second terminal part and the second connector to the insulating part and to electrically connect the second terminal part and the second connector.

The first connector may be formed into a cylindrical shape having the hollow hole part, and the first terminal part may include a first terminal coupled to the first cable, and a second terminal integrated with the first terminal and coupled to an outer surface of the first connector.

The first connector may include a large diameter part into which the insulating part is inserted, wherein the second connector is disposed in the insulating part, and wherein an outer circumferential surface of the first connector is coupled with the first terminal part, a small diameter part having an inner diameter that is less than an inner diameter of the large diameter part, wherein the small diameter part comprises an entrance disposed to face inside of the cavity and into which a portion of the probe is inserted, and a step part protruding from the outer circumferential surface of the large diameter part.

The first terminal part and the first connector may electrically connect to each other, the second terminal part and the second connector may electrically connect to each other, and the first connector and the second connector may electrically separate from each other.

According to an embodiment of the present disclosure, a cooking appliance may include a socket. The socket may pass through a cavity of a cooking space and be mounted onto the cavity, and a probe may be readily attached to and detached from the socket, thereby making it possible to easily measure a temperature of the cooking space or a food item stored in the cooking space.

In the cooking appliance, a stopper may protrude from an insulating part to effectively suppress rotation of a second terminal part during assembly of the socket, thereby making it possible to reduce a risk on a user and damage to the cooking appliance, which may be caused by an electrical short of the first cable and the second cable, which occurs when the second terminal part contacts the first connector as a result of a rotation of the second terminal part.

In the cooking appliance, a rotation suppressing part may be disposed in a terminal mounting groove of the insulating part, thereby effectively suppressing rotation of the second terminal part during assembly of the socket.

The cooking appliance may be provided with the stopper or the rotation suppressing part, thereby making it possible to reduce a risk on a user and damage to the cooking appliance, caused by an electrical short of the first cable and the second cable, which occurs when the second terminal part contacts the first connector as a result of a rotation of the second terminal part.

Specific effects are described along with the above-described effects in the section of Detailed Description.

Aspects, features, and advantages of the present disclosure are not limited to those described above. It is understood that other aspects, features, and advantages not mentioned above can be clearly understood from the following description and can be more clearly understood from the embodiments set forth herein. Additionally, it is understood that various aspects, features, and advantages described herein can be realized via means and combinations thereof that are described in the appended claims.

BRIEF DESCRIPTION OF DRAWING

The accompanying drawings constitute a part of the specification and illustrate one or more embodiments in the disclosure, and together with the specification, explain the disclosure.

DETAILED DESCRIPTION

Figure 1:
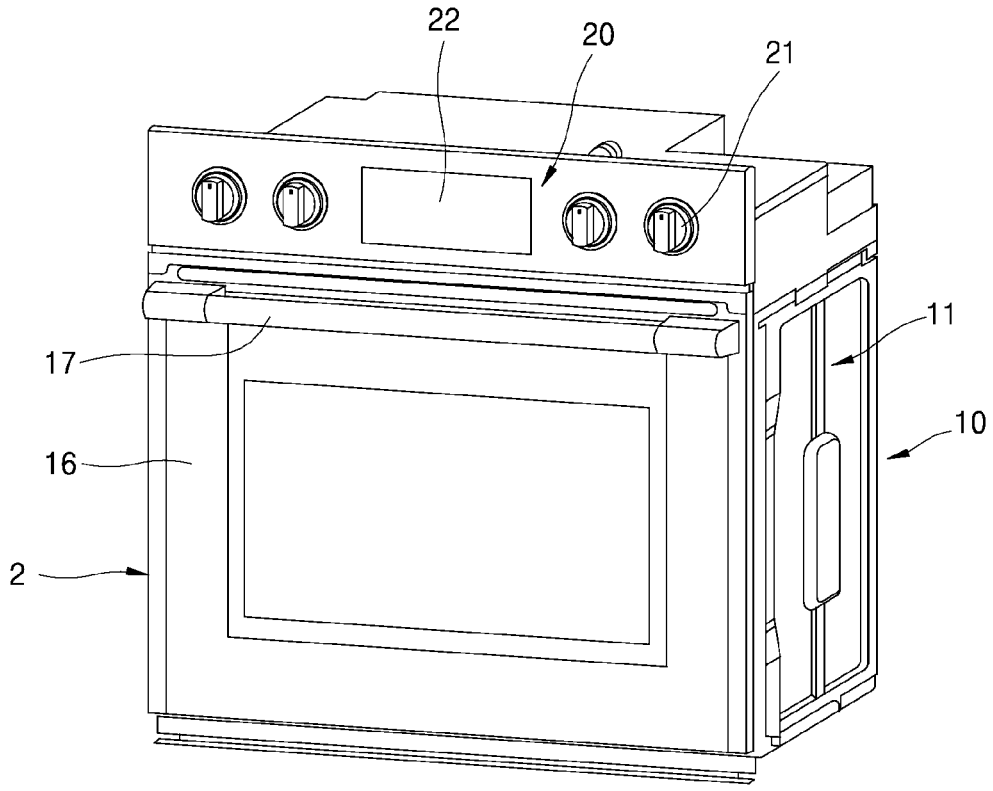
FIG. 1 is a perspective view showing a cooking appliance according to an embodiment of the present disclosure.

Reference will now be made to the exemplary embodiments illustrated in the drawings, and specific language will be used here to describe the same. It will nevertheless be understood that no limitation of the scope of the invention is thereby intended. Alterations and further modifications of the inventive features illustrated here, and additional applications of the principles of the inventions as illustrated here, which would occur to a person skilled in the relevant art and having possession of this disclosure, are to be considered within the scope of the invention.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Various terminology used herein can imply direct or indirect, full or partial, temporary or permanent, action or inaction. For example, when an element is referred to as being "on," "connected" or "coupled" to another element, then the element can be directly on, connected or coupled to the other element or intervening elements can be present, including indirect or direct variants. In contrast, when an element is referred to as being "directly connected" or "directly coupled" to another element, there are no intervening elements present.

Figure 2:
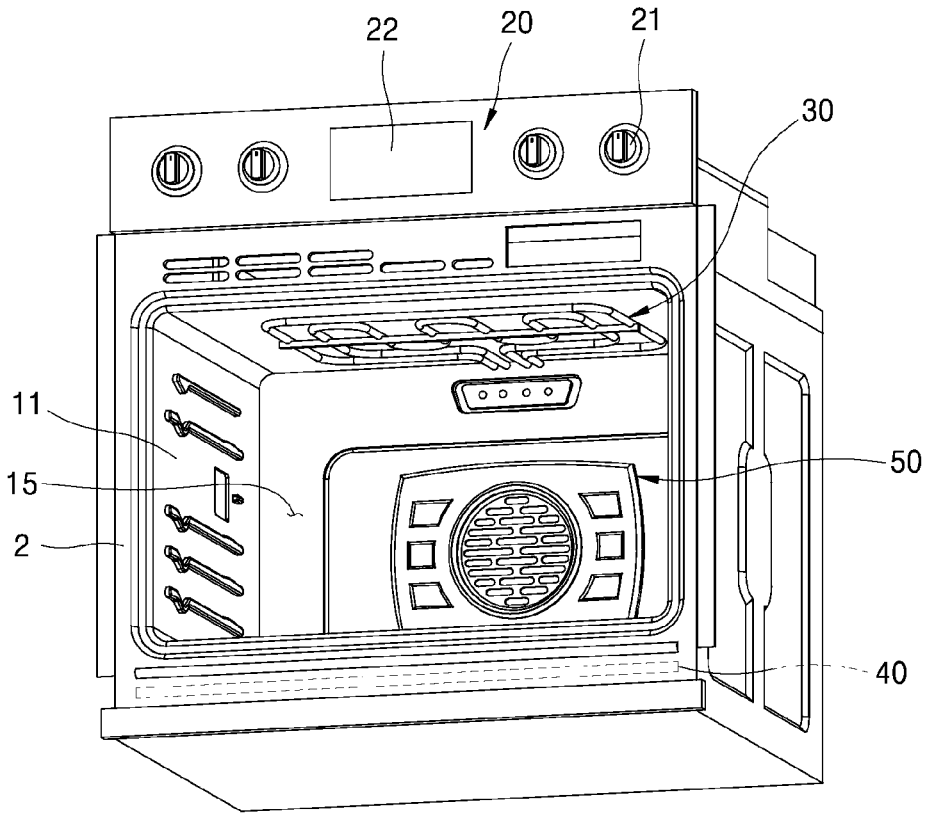
FIG. 2 is a perspective view showing the cooking appliance according to an embodiment shown in FIG. 1, and for clarity of illustration, the cooking appliance is shown without a door.

FIG. 1 is a perspective view showing a cooking appliance according to an embodiment of the present disclosure. FIG. 2 is a perspective view showing the cooking appliance illustrated in FIG. 1. In FIG. 2, a door 16 is omitted for clarity of description.

Referring to FIGS. 1 and 2, an exterior of the cooking appliance may be formed by a main body 10. The main body 10 may have an approximately rectangular cuboid shape (not limited thereto) and made of a material having a predetermined strength to protect components installed in an inner space thereof.

The main body 10 may include a cavity 11 forming a skeleton (or a frame) of the main body 10, and a front panel 2 disposed at a front side of the cavity 11 and forming a front surface of the main body 10. A cooking space 15 may be formed in the cavity 11, and the main body 10 may include an opening disposed behind the front panel 2 to provide access to the cooking space 15.

The cooking space 15 may be formed in the main body 10. The cooking space 15 may be formed into an approximate cuboid shape (or any other suitable shape) having a front surface that is open. When an inner space of the cooking space 15 is heated with the cooking space 15 shielded, a food item in the cooking space 15 may be cooked. That is, in the cooking appliance, the inner space of the cooking space 15 may be a space for substantially cooking a food item.

The cooking appliance may be provided with a heating part configured to heat the cooking space 15. For example, the heating part may include an upper heater 30 configured to heat an inner space of the cooking space 15 from above. The upper heater 30 may be disposed on an upper side of the cooking appliance 15.

Additionally, the heating part may include a lower heater 40 configured to heat the inner space of the cooking space 15 from below. The lower heater 40 may be disposed on a lower side of the cooking space 15. Additionally, the heat part may include a convection device 50 configured to heat the inner space of the cooking space 15 as a result of convection of hot air. The convention device 50 may be disposed at a rear of the cooking space 15.

A door 16 configured to selectively open the cooking space 15 may be disposed at a front side of the main body 10 in a rotatable manner. For example, the door 16 may be a pull-down type door, an upper end of which rotates with respect to a lower end thereof in an up-down direction such that the cooking space 15 is opened.

The door 16 may be formed into a cuboid shape (or any other suitable shape) having a predetermined thickness. The door 16 may be provided with a handle 17 on a front surface thereof such that a user grips the handle 17 to rotate the door 16.

A control panel 20 may be disposed at an upper portion of a front surface of the cooking appliance, e.g., on a front surface of an upper portion of the cavity 11. The control panel 20 may form a portion of an exterior of the front surface of the cooking appliance. The control panel 20 may be provided with a knob 21 for adjusting operation of the cooking appliance, a display 22 for displaying an operation state of the cooking appliance and the like, thereon.

The cooking appliance may be further provided with a steam supplying device. The steam supplying device may be installed in the main body 10 and configured to supply steam into the cooking space 15.

Figure 3:
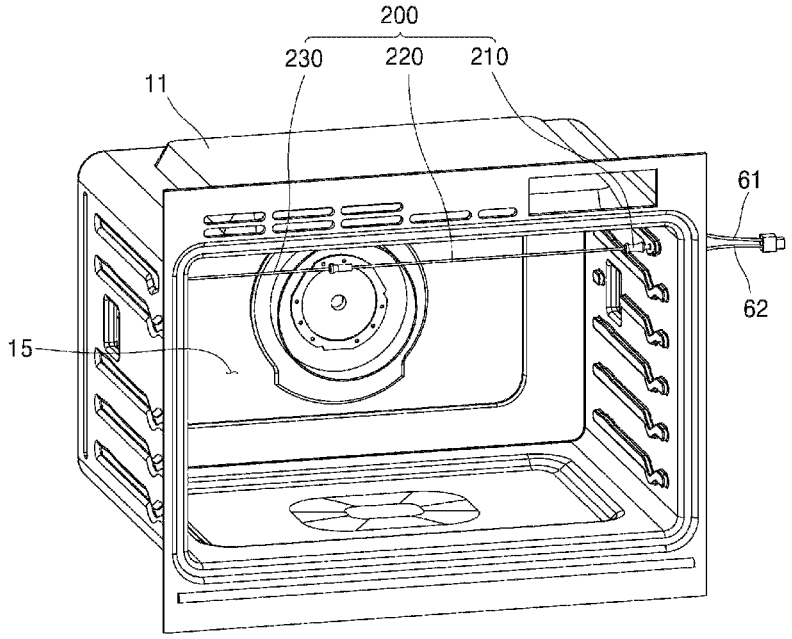
FIG. 3 is a perspective view showing a state in which a probe is mounted onto a cavity according to an embodiment of the present disclosure.
Figure 4:
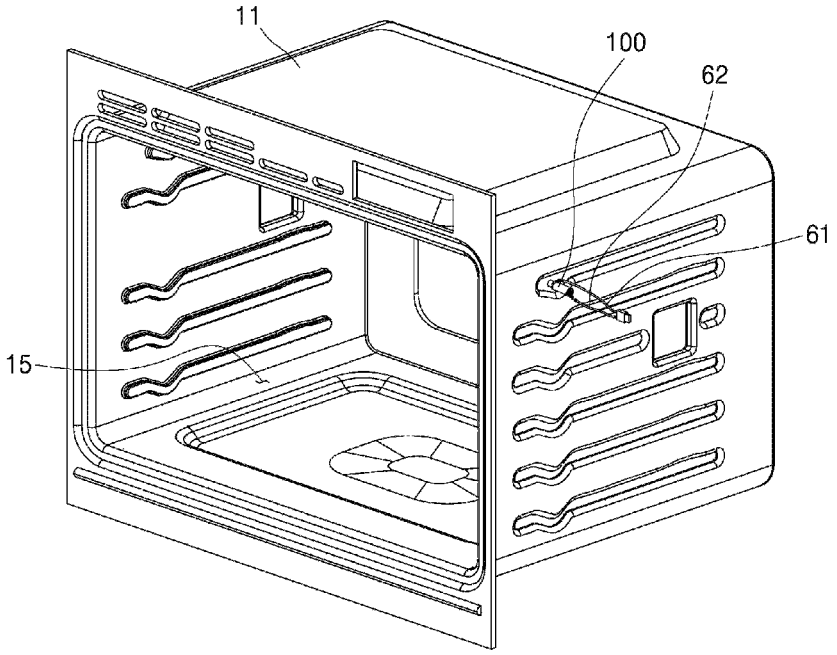
FIG. 4 is a perspective view showing FIG. 3 at a different angle according to an embodiment of the present disclosure.
Figure 5:
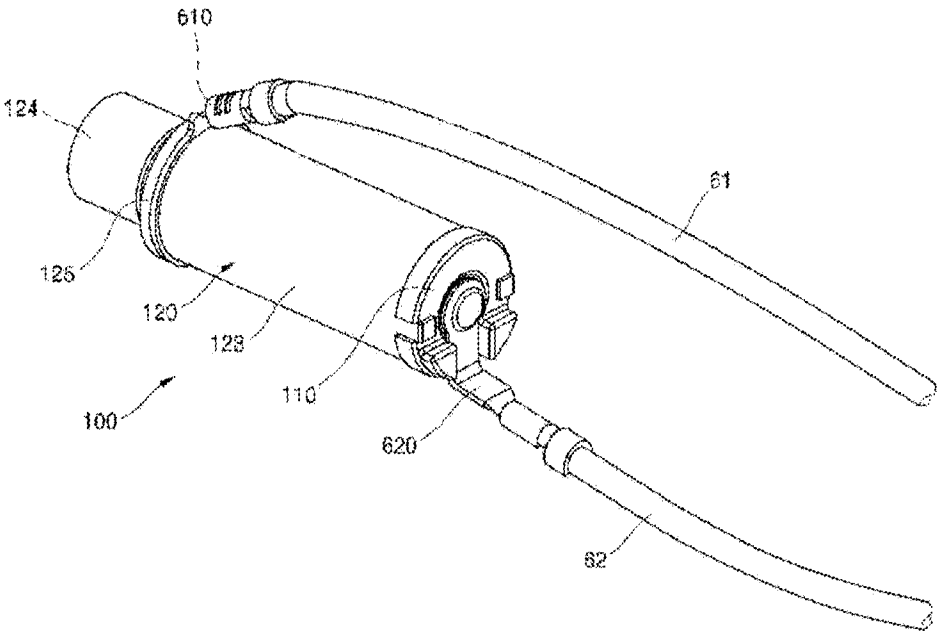
FIG. 5 is a perspective view showing a socket according to an embodiment of the present disclosure.

FIG. 3 is a perspective view showing a state in which a probe 200 is disposed or mounted onto a cavity 11. FIG. 4 is a perspective view showing FIG. 3 at a different angle. FIG. 5 is a perspective view showing a socket 100 in one embodiment of the present disclosure.

Figure 6:
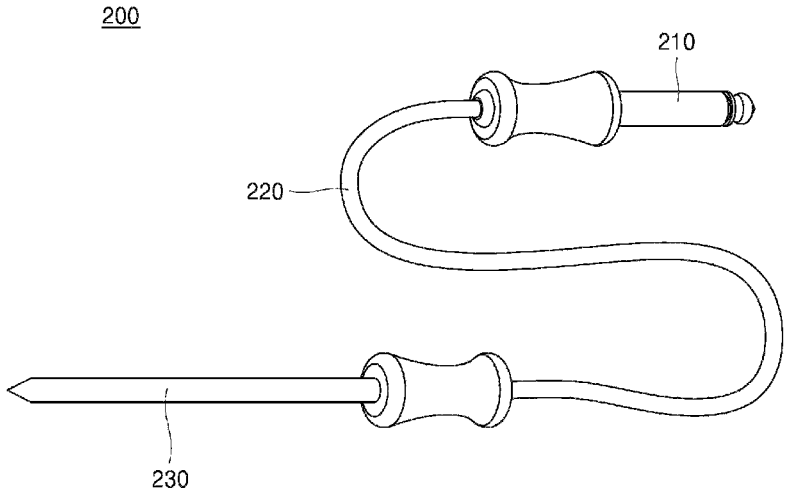
FIG. 6 is a view showing a probe according to an embodiment of the present disclosure.
Figure 7:
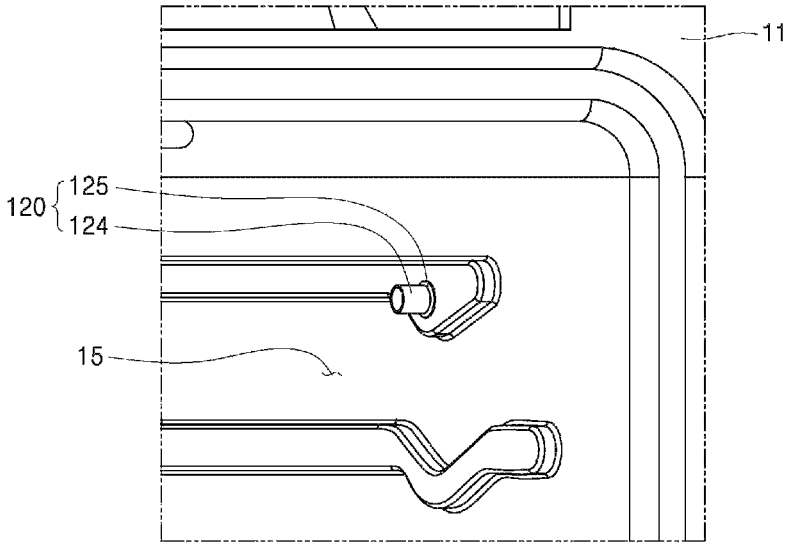
FIG. 7 is a view showing a state in which a socket is mounted onto a cavity according to an embodiment of the present disclosure.
Figure 8:
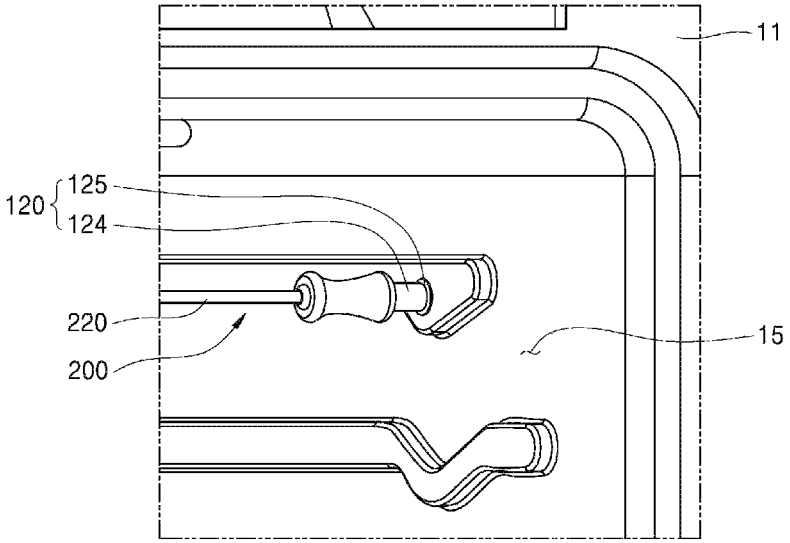
FIG. 8 is a view showing a state in which a probe is mounted onto the socket in FIG. 7 according to an embodiment of the present disclosure.

FIG. 6 is a view showing a probe 200 according to one embodiment of the present disclosure. FIG. 7 is a view showing a state in which a socket 100 is mounted onto a cavity 11. FIG. 8 is a view showing a state in which a probe 200 is mounted onto the socket 100 in FIG. 7.

The cooking appliance may be provided with a probe 200. The probe 200 may be provided in addition to the cooking appliance, and inserted into a food item stored in the cooking space 15 to measure a temperature of the food item. When not inserted into a food item, the probe 200 may measure a temperature of the cooking space 15.

Results of temperatures measured by the probe 200 may be used as data for controlling output of the heating part and automatic cooking of the heating part.

The probe 200 may detachably connect to the socket 100 provided to the cooking space 15. In this example, the socket 100 may electrically connect the probe 200 with a control device or power.

In one example, at least a portion of the socket 100 may pass through the cavity 11 and may be disposed in the cooking space 15. Accordingly, the cavity 11 may be provided with a through hole through which the socket 100 passes through to be disposed in the cooking space 15.

In this example, at least a portion of a small diameter part 124 of the socket 100 may be disposed in the cooking space 15, and a connecting jack 210 of the probe 200 may be inserted into the small diameter part 124, such that the probe 200 and the socket 100 are electrically connected to each other.

The socket 100 may include an insulating part 110, a first connector 120, and a second connector 130.

The insulating part 110 may connect to the socket 100 and may electrically insulate a first cable 61 from a second cable 62 that constitute different power lines (or cables). A second terminal part 620 provided to (e.g., coupled or connected to) the second cable 62 may be mounted onto the insulating part 110. Additionally, the insulating part 110 may be provided with a terminal mounting groove 1121 onto which the second terminal part 620 provided to the second cable 62 is mounted, and the terminal mounting groove 1121 may include a depression.

The insulating part 110 may be made of a material such as a ceramic material (or any other suitable material) having high heat resistance, corrosion resistance, and electric insulation since the insulating part 110 is disposed in the cooking space 15 under high temperature settings.

The first connector 120 may include a hollow hole part 121, and the insulating part 110 may be disposed in a portion of the hollow hole part 121. The first connector 120 may be formed into a cylindrical shape (or any other suitable shape) provided with the hollow hole part 121.

A first terminal part 610 provided to (e.g., coupled or connected to) the first cable 61 may electrically connect to an outside of the first connector 120. Additionally, the first connector 120 may be provided with a coupling projection 122 for coupling with the insulating part 110, at one end thereof.

The first connector 120 may be made of a metallic material such as copper, aluminum, an alloy including copper or aluminum, or the like having high electric conductivity.

The second connector 130 may be disposed in the hollow hole part 121 and electrically connected to the second terminal part 620. The second connector 130 may be made of a metallic material such as copper, aluminum, an alloy including copper or aluminum, or the like having high electric conductivity.

The first terminal part 610 may be coupled to the first cable 61 and the first connector 120 to electrically connect the first cable 61 and the first connector 120 together, and may include a first terminal 611 and a second terminal 612. In one example, the first terminal 611 and the second terminal 612 may be formed integrally.

The first terminal 611 may be coupled to the first cable 61. The second terminal 612 may be integrated with the first terminal 611, and may be coupled to an outer surface of the first connector 120.

Since the first connector 120 is formed into a cylindrical shape, the second terminal 612 may be formed into a ring corresponding to an outer circumference of the first connector 120 such that the second terminal 612 is coupled to the first connector 120.

Thus, the first cable 61 and the second cable 62 may be electrically insulated from each other by the insulating part 110 when the first cable 61 and the second cable 62 are electrically connected to the socket 100. In this example, when the probe 200 is mounted onto the socket 100, the probe 200 may be electrically connected to the first cable 61 and the second cable 62.

With the foregoing structure, the first terminal part 610 and the first connector 120 may be electrically connected to each other, and the second terminal part 620 and the second connector 130 may be electrically connected to each other. However, the first connector 120 and the second connector 130 may be electrically separate (or disconnected) from each other.

Each of the first connector 120 and the second connector 130 may be electrically connected to the probe 200. Accordingly, information (or data) on temperatures sensed by a temperature measuring part 230 of the probe 200 may be transmitted to the control device through the first cable 61 and the second cable 62.

Referring to FIGS. 7 and 8, the connecting jack 210 of the probe 200 may be inserted into the small diameter part 124 of the socket 100 exposed to the cooking space 15 such that the probe 200 is electrically connected to the socket 100.

Referring to FIG. 6, the probe 200 may include a connecting jack 210, a third cable 220, and a temperature measuring part 230.

The connecting jack 210 may be inserted into, and attached to and detached from the first connector 120. When the connecting jack 210 is disposed in the first connector 120 of the socket 100, the probe 200 may be electrically connected to the first cable 61 and the second cable 62 through the socket 100.

The third cable 220 may be provided with two different power lines, and one end of the third cable 220 may be electrically connected to the connecting jack 210 while the other end may be electrically connected to the temperature measuring part 230.

The temperature measuring part 230 may be electrically connected to the other end of the third cable 220 and may measure a temperature of the cooking space 15 or a food item stored in the cooking space 15.

The probe 200 may be configured to operate under high temperature settings such as the cooking space 15, e.g., in a thermal couple manner.

In one embodiment of the present disclosure, the socket 100 may pass through the cavity 11 of the cooking space 15 and be disposed at the cavity 11, and the probe 200 may be attached to and detached from the socket 100 such that the probe 200 measures a temperature of the cooking space 15 or a food item stored in the cooking space 15.

Figure 9:
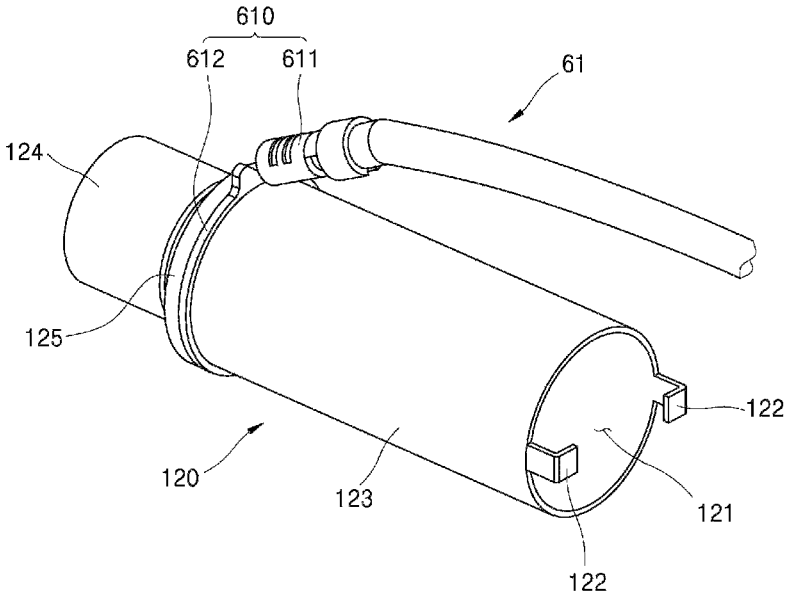
FIG. 9 is a view showing a state in which a first cable connects to a first connector of the socket according to an embodiment of the present disclosure.
Figure 10:
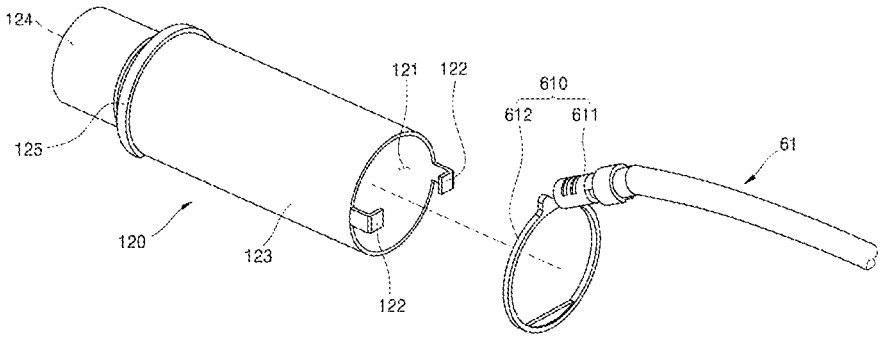
FIG. 10 is a view showing a state in which the first connector and a second cable separate from each other in FIG. 9 according to an embodiment of the present disclosure.
Figure 11:
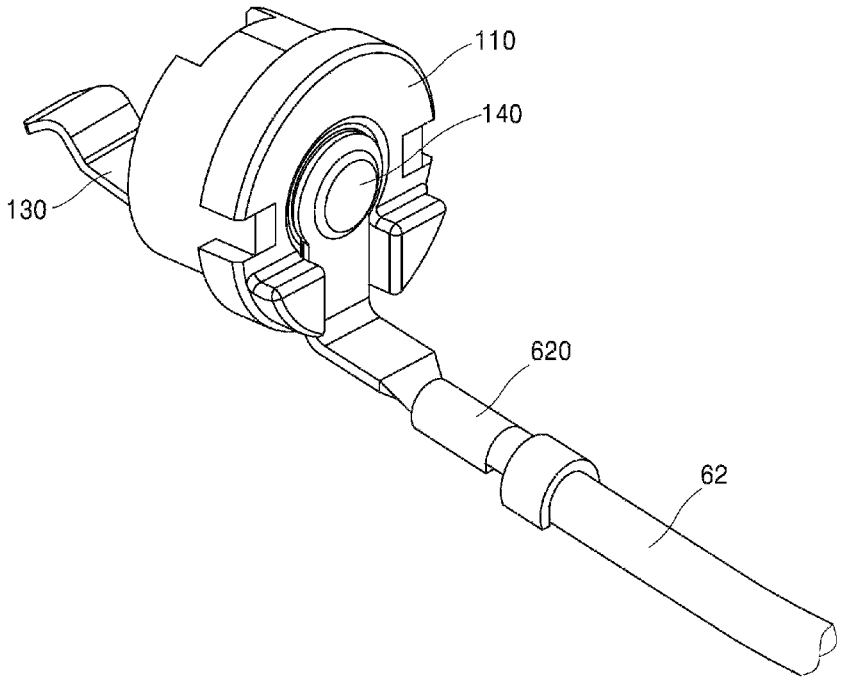
FIG. 11 is a view showing a state in which a second cable connects to a second connector of the socket according to an embodiment of the present disclosure.
Figure 12:
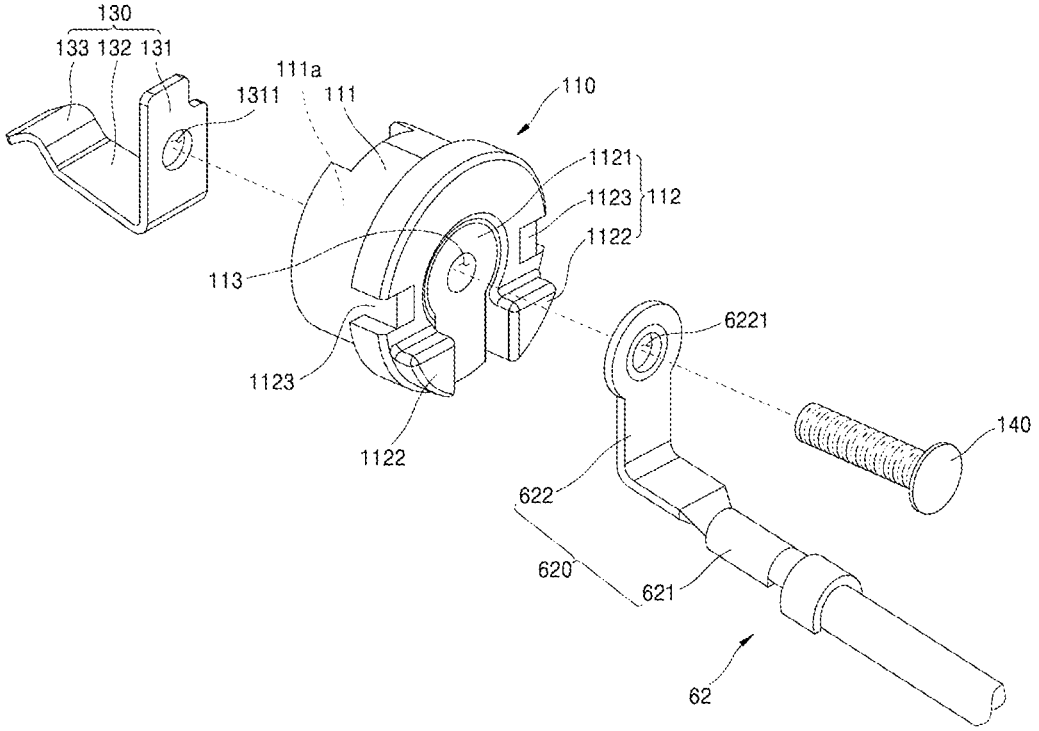
FIG. 12 is an exploded view of FIG. 11.

FIG. 9 is a view showing a state in which a first cable 61 connects to a first connector 120 of the socket 100 in one embodiment of the present disclosure. FIG. 10 is a view showing a state in which the first connector 120 and a second cable 62 separate from each other in FIG. 9. FIG. 11 is a view showing a state in which a second cable 62 connects to a second connector 130 of the socket 100 in one embodiment of the present disclosure. FIG. 12 is an exploded view of FIG. 11.

Referring to FIG. 12, the insulating part 110 may include an inserting part 111 and a terminal mounting part 112.

The inserting part 111 may be formed into a cylindrical shape having a hollow hole 111*a* and may be inserted into the hollow hole part 121 of the first connector 120, and at least a portion of the second connector 130 may be disposed in the inserting part 111.

Referring to FIG. 11, a portion of the second connector 130 may be disposed in the hollow hole 111*a* of the inserting part 111 in a state in which the second connector 130 and the insulating part 110 are coupled together by a coupling tool 140. When the connecting jack 210 is inserted into the first connector 120 in this state, the connecting jack 210 and the second connector 130 may contact each other and may be electrically connected to each other.

The terminal mounting part 112 may have a circular outer circumferential surface and may be configured to close one side of the inserting part 111, and the second terminal part 620 may be mounted onto the terminal mounting part 112. The terminal mounting part 112 may include a terminal mounting groove 1121 and a stopper 1122.

The terminal mounting groove 1121 may be depressed such that the second terminal part 620 is mounted onto the terminal mounting groove 1121. The terminal mounting groove 1121 may be formed on an outer surface of the terminal mounting part 112 and have a shape corresponding to a shape of a fourth terminal 622 of the second terminal part 620.

A pair of stoppers 1122 may protrude from both sides of the terminal mounting groove 1121 and may be configured to suppress a rotation of the second terminal part 620. The stoppers 1122 may protrude in a direction opposite to the direction in which the terminal mounting groove 1121 is depressed.

Referring to FIG. 12, the second terminal part 620 may include a third terminal 621 and a fourth terminal 622. In this, example, the third terminal 621 and the fourth terminal 622 may be integrally formed.

The third terminal 621 may be coupled to the second cable 62, and a lengthwise direction of the third terminal 621 may be approximately aligned with a lengthwise direction of the second cable 62.

The fourth terminal 622 may be bent from the third terminal 621 and may have a first through hole 6221. The coupling tool 140 may pass through the first through hole 6221, and the fourth terminal 622 may be coupled to the insulating part 110 through the coupling tool 140.

As illustrated in FIG. 12, an area around the first through hole 6221 of the fourth terminal 622 in one embodiment of the present disclosure may be rounded, and both sides of a portion of the fourth terminal 622, connected to the third terminal 621, may be formed into line. In some embodiments of the present disclosure, a shape of the fourth terminal 622 in may be described with reference to FIG. 12.

During a coupling of the second terminal part 620 of the second cable 62, a portion of the fourth terminal 622 of the second terminal part 620 may be deformed and separated from the terminal mounting groove 1121. In this example, the fourth terminal 622 may not be mounted onto the terminal mounting groove 1121 and may be rotated.

When the socket 100 is disposed at the cavity 11, the first connector 120 may be disposed from inside of the cavity 11 to outside of the cavity 11 through a through hole of the cavity 11. Thereafter, the insulating part 110 may be mounted onto the first connector 120. The insulating part 110 may be coupled to the first connector 120 through the coupling projection 122 of the first connector 120.

Referring to FIG. 5, a portion of the coupling projection 122 of the first connector 120 may be disposed near the terminal mounting groove 1121 of the insulating part 110. In one exemplary scenario, the fourth terminal 622 of the second cable 62 may rotate and contact the coupling projection 122.

When the fourth terminal 622 is mounted onto the insulating part 110 by rotating into the coupling tool 140, the socket 100 may be assembled with the fourth terminal 622 being rotated, and in the state with the fourth terminal 622 contacting the coupling projection 122.

In this example, the first cable 61 may become electrically connected to the first connector 120, and the first cable 61 to which the second terminal part 620 is coupled may become electrically connected to each other, causing an electrical short.

In this state, the first cable 61 and the second cable 62 may become electrically connected to each other to cause an electrical short, thereby imposing a risk on a user and cause damage to the socket 100 and the cooking appliance although the probe 200 is not mounted onto the first cable 61 and the second cable 62.

In one embodiment of the present disclosure, the stopper 1122 may be provided to suppress a rotation of the fourth terminal 622. Thus, an electrical short between the first cable 61 and the second cable 62, caused by a rotation of the fourth terminal 622, may be suppressed during assembly of the socket 100.

A height at which the stopper 1122 protrudes may be appropriately determined corresponding to the shape of the fourth terminal 622 during assembly of the socket 100.

For example, during assembly of the socket 100, the fourth terminal 622 may separate at a portion near the third terminal 621 rather than a rounded portion where the first through hole 6221 is formed. The fourth terminal 622 may separate by less than 1.5 mm from a surface thereof facing the terminal mounting groove 1121 from a surface of the terminal mounting groove 1121.

Accordingly, the height at which the stopper 1122 protrudes may be appropriately determined within a range of greater than 1.5 mm from the surface of the terminal mounting groove 1121 to an end of the stopper 1122.

In one embodiment of the present disclosure, the stopper 1122 protruding from the insulating part 110 may effectively suppress a rotation of the second terminal part 620 during assembly of the socket 100.

Thus, a risk on a user and damage to the cooking appliance, caused by an electrical short between the first cable 61 and the second cable 62, which occurs when the second terminal part 620 contacts the first connector 120 as a result of a rotation of the second terminal part, may be effectively reduced.

A pair of terminal mounting parts 112 may be provided, and a portion of an outer circumferential surface of the terminal mounting part 112 may be pushed down. The terminal mounting part 112 may further include a coupling groove 1123 to which the coupling projection 122 of the first connector 120 is coupled.

Referring to FIGS. 5 and 12, the coupling groove 1123 may be formed in a way that a portion of the outer circumferential surface of the terminal mounting part 112 or a portion of a front surface of the terminal mounting part 112 is depressed. The coupling groove 1123 may have a bent shape. Accordingly, the coupling projection 122 may be bent approximately in the middle of the length thereof and mounted onto the coupling groove 1123 such that the first connector 120 and the insulating part 110 are coupled to each other.

As illustrated in FIGS. 9 and 10, the first connector 120 may include a large diameter part 123, a small diameter part 124, and a step part 125.

The insulating part 110 may be inserted into the large diameter part 123, the second connector 130 may be disposed in the large diameter part 123, and the first terminal part 610 may be coupled to an outer circumferential surface of the large diameter part 123. Since the second connector 130 is disposed in the large diameter part 123, the large diameter part 123 may have an inner diameter greater than an inner diameter of the small diameter part 124. Thus, a space occupied by the second connector 130 may increase, and a contact between the second connector 130 and the first connector 120 may be avoided.

The small diameter part 124 may have an inner diameter less than the inner diameter of the large diameter part 123, and an entrance of the small diameter part 124 may be disposed to face the inside of the cavity 11 such that a portion of the probe 200 is inserted into the entrance of the small diameter part 123. The connecting jack 210 of the probe 200 may be inserted into the small diameter part 124 and may be electrically connected to the second connector 130 disposed in the large diameter part 123.

The step part 125 may be formed to protrude from the outer circumferential surface of the large diameter part 123. Referring to FIG. 7, when the first connector 120 is mounted from the inside of the cavity 11 to the outside of the cavity 11 during assembly of the socket 100, an outer diameter of the step part 125 may be greater than a diameter of the through hole of the cavity 11 to prevent the socket 100 from escaping from the cavity 11.

The insulating part 110 may pass through the terminal mounting part 112, and the insulating part 110 may further include a second through hole 113 formed at a position corresponding to a position of the first through hole 6221 to mount the fourth terminal 622 onto the terminal mounting part 112.

Since the coupling tool 140 is fastened to the first through hole 6221 and the second through hole 113, the insulating part 110 and the second terminal part 620 may be coupled to each other.

Referring to FIG. 12, the second connector 130 may include a first cell 131, a second cell 132, and a third cell 133. The first cell 131, the second cell 132, and the third cell 133 may be integrally formed.

The first cell 131 may be coupled to the insulating part 110, and may further include a third through hole 1311 corresponding to the second through hole 113. When the coupling tool 140 is fastened to the second through hole 113, the second connector 130 and the insulating part 110 may be coupled to each other.

The second cell 132 may be bent and may extend from the first cell 131. One end of the second cell 132 may be coupled to the first cell 131, and the third cell 133 may be formed at the other end of the second cell 132.

The third cell 133 may extend from the second cell 132, have a groove shape, and contact the connecting jack 210 of the probe 200. When the connecting jack 210 is inserted into the socket 100, the connecting jack 210 may contact the third cell 133, and the probe 200, the second connector 130, and the second cable 62 may electrically connect to one another.

The socket 100 may further include a coupling tool 140. The coupling tool 140 may be inserted into the first through hole 6221, the second through hole 113, and the third through hole 1311 to couple the second terminal part 620 and the second connector 130 to the insulating part 110 and to electrically connect the second terminal part 620 and the second connector 130.

The coupling tool 140 may be made of an electrically conductive material, and may include a screw bolt, a screw nail, a rivet, or the like, for example.

As illustrated in FIGS. 5 and 11, when the coupling tool 140 is fastened to the socket 100, the second connector 130, the coupling tool 140, the second terminal part 620, and the second cable 62 may electrically connect to one another, and when the connecting jack 210 is inserted into the socket 100, the probe 200 and the second cable 62 may electrically connect to each other.

Figure 13:
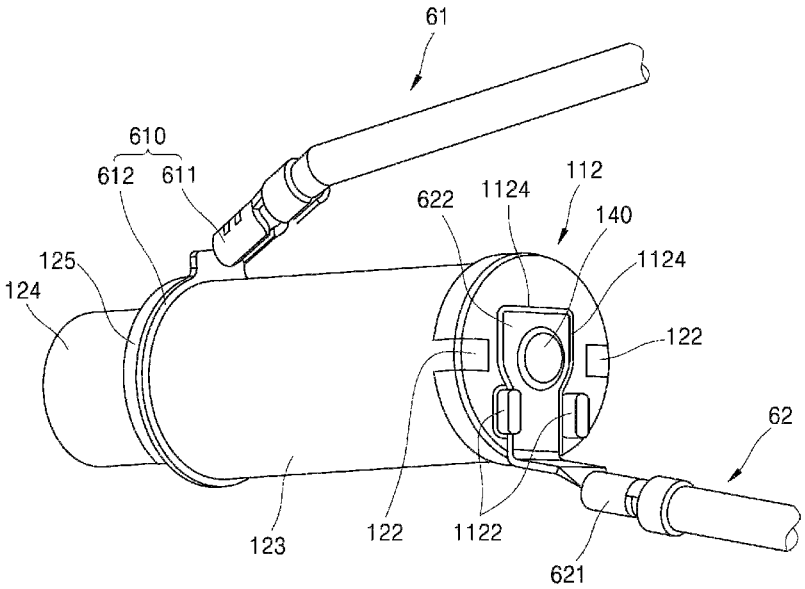
FIG. 13 is a perspective view showing a socket according to another embodiment of the present disclosure.
Figure 14:
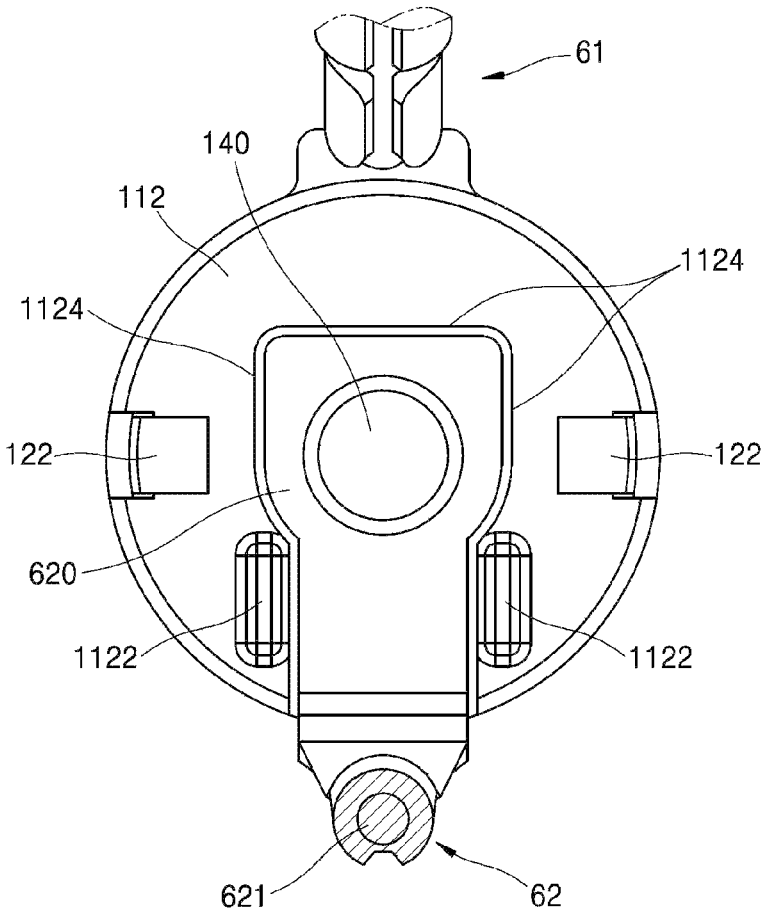
FIG. 14 is a front view of FIG. 13.

FIG. 13 is a perspective view showing a socket 100 in another embodiment of the present disclosure. FIG. 14 is a front view of FIG. 13.

The terminal mounting groove 1121 may be provided with a rotation suppressing part 1124 that is formed in a way that outer lines (or perimeter) of a depression are disposed in directions that cross each other, to suppress rotation of the fourth terminal 622. For example, as shown in FIG. 14, the terminal mounting groove 1121 may have a perimeter having a shape configured to suppress rotation of the fourth terminal 622. The rotation suppressing part 1124 may suppress rotation of the second terminal part 620 by suppressing rotation of the fourth terminal 622.

The rotation suppressing part 1124 may be formed in a way that a portion of an outer line (or perimeter) of the terminal mounting groove 1121 is formed into straight lines and the straight lines are disposed not to meet each other/to cross each other. In this example, a portion in which the straight lines cross each other may be rounded to improve convenience and safety of processing.

The shape of the rotation suppressing part 1124 may not be limited to the shapes illustrated in FIGS. 13 and 14. In another embodiment of the present disclosure, the rotation suppressing part 1124 may be formed in a way that a portion of the outer line of the terminal mounting groove 1121 has star-shaped unevenness.

A portion in which outer lines (or perimeter) are disposed in directions that cross each other may be formed at the fourth terminal 622 of the second terminal part 620 such that the fourth terminal 622 has a shape corresponding to the shape of the rotation suppressing part 1124.

To appropriately suppress rotation of the fourth terminal 622, a portion of the outer line of the fourth terminal 622 may have a shape corresponding to the shape of the rotation suppressing part 1124.

That is, when the rotation suppressing part 1124 has star-shaped unevenness, a portion of the outer line of the fourth terminal 622 may have a shape corresponding to the shape of the rotation suppressing part 1124.

The rotation suppressing part 1124 may serve as the stopper 1122 described above. The rotation suppressing part 1124 may appropriately suppress rotation of the second terminal part 620 by suppressing rotation of the fourth terminal 622 with respect to the insulating part 110 during assembly of the socket 100.

Accordingly, a risk on a user and damage to the cooking appliance, caused by an electrical short between the first cable 61 and the second cable 62, which occurs when the second terminal part 620 contacts the first connector 120 as a result of a rotation of the second terminal part 620, may be effectively reduced.

The embodiments are described above with reference to a number of illustrative embodiments thereof. However, the present disclosure is not intended to limit the embodiments and drawings set forth herein, and numerous other modifications and embodiments can be devised by one skilled in the art without departing from the technical spirit of the disclosure. Further, the effects and predictable effects based on the configurations in the disclosure are to be included within the range of the disclosure though not explicitly described in the description of the embodiments.

Description of Reference Numeral

| | | | |
|---|---|---|---|
| 2: | Front panel | 10: | Main body |
| 11: | Cavity | 15: | Cooking space |
| 16: | Door | 17: | Handle |
| 20: | Control panel | 21: | Knob |
| 22: | Display | 30: | Upper heater |
| 40: | Lower heater | 50: | Convection device |
| 61: | First cable | 610: | First terminal part |
| 611: | First terminal | 612: | Second terminal |
| 62: | Second cable | 620: | Second terminal part |
| 621: | Third terminal | 622: | Fourth terminal |
| 6221: | First through hole | 100: | Socket |
| 110: | Insulating part | 111: | Inserting part |
| 111a: | Hollow hole | 112: | Terminal mounting part |
| 1121: | Terminal mounting groove | 1122: | Stopper |
| 1123: | Coupling groove | 1124: | Rotation suppressing part |
| 113: | Second trough hole | 120: | First connector |
| 121: | Hollow hole part | 122: | Coupling projection |
| 123: | Large diameter part | 124: | Small diameter part |
| 125: | Step part | 130: | Second connector |
| 131: | First cell | 1311: | Third through hole |
| 132: | Second cell | 133: | Third cell |
| 140: | Coupling tool | 200: | Probe |
| 210: | Connecting jack | 220: | Third cable |
| 230: | Temperature measuring part | | |

What is claimed is:

1. A cooking appliance, comprising:

a cavity including a cooking space;

a socket at least partially disposed in the cooking space; and a probe detachably connected to the socket and configured to measure a temperature of the cooking space or a food item stored in the cooking space;

the socket, comprising:

an insulating part configured to electrically insulate a first cable from a second cable;

a first connector having a hollow hole part and a coupling projection for coupling one end of the first connector to the insulating part, wherein the insulating part is disposed in a portion of the hollow hole part, wherein a first terminal part coupled to the first cable is electrically connected to outside of the first connector, and wherein a second terminal part coupled to the second cable is mounted on the insulating part; and a second connector disposed in the hollow hole part and electrically connected to the second terminal part, wherein the insulating part comprises:

an inserting part having a hollow hole and inserted into the hollow hole part of the first connector, at least a portion of the second connector being disposed in the hollow hole part; and a terminal mounting part configured to close one side of the inserting part, the second terminal part being mounted on the terminal mounting part, the terminal mounting part comprises a pair of coupling grooves, a portion of an outer circumferential surface of each of the pair of coupling grooves is depressed, and wherein the coupling projection of the first connector is coupled to the pair of coupling grooves.

2. The cooking appliance of claim 1, wherein the terminal mounting part further comprises:

a terminal mounting groove having a depression, the second terminal part being mounted on the depression; and a pair of stoppers protruding from opposite sides of the terminal mounting groove and configured to suppress rotation of the second terminal part.

3. The cooking appliance of claim 2, wherein the second terminal part comprises:

a third terminal coupled to the second cable; and a fourth terminal bent from the third terminal having a first through hole.

4. The cooking appliance of claim 3, wherein the terminal mounting groove comprises a rotation suppressing part, wherein the rotation suppressing part comprises a perimeter corresponding to the depression, wherein the perimeter comprises a shape configured to suppress rotation of the fourth terminal, and wherein the fourth terminal comprises a perimeter having a shape corresponding to the shape of the perimeter of the rotation suppressing part.

5. The cooking appliance of claim 3, wherein the insulating part further comprises a second through hole passing through the terminal mounting part, and wherein, when the fourth terminal is mounted onto the terminal mounting part, the fourth terminal is disposed at a position corresponding to the second through hole.

6. The cooking appliance of claim 5, wherein the probe comprises:

a connecting jack detachably coupled to the first connector;

a third cable comprising one end being electrically connected to the connecting jack; and a temperature measuring part electrically connected to the other end of the third cable and configured to measure a temperature of the cooking space or a food item stored in the cooking space.

7. The cooking appliance of claim 6, wherein the second connector further comprises:

a first cell coupled to the insulating part and comprising a third through hole corresponding to the second through hole;

a second cell bent and extended from the first cell; and a third cell extended from the second cell, the third cell having a groove shape and contacting the connecting jack of the probe.

8. The cooking appliance of claim 7, wherein the socket further comprises a coupling tool inserted into the first through hole, the second through hole, and the third through hole to couple the second terminal part and the second connector to the insulating part and to electrically connect the second terminal part and the second connector.

9. The cooking appliance of claim 1, wherein the first connector has a cylindrical shape, and wherein the first terminal part comprises:

a first terminal coupled to the first cable; and a second terminal integrated with the first terminal and coupled to an outer surface of the first connector.

10. The cooking appliance of claim 9, wherein the first connector further comprises: a large diameter part into which the insulating part is inserted, wherein the second connector is disposed in the insulating part, and wherein an outer circumferential surface of the first connector is coupled with the first terminal part;

a small diameter part having an inner diameter that is less than an inner diameter of the large diameter part, wherein the small diameter part comprises an entrance disposed to face inside of the cavity where a portion of the probe is inserted into; and a step part protruding from the outer circumferential surface of the large diameter part.

11. The cooking appliance of claim 1, wherein the first terminal part and the first connector are electrically connected to each other, wherein the second terminal part and the second connector are electrically connected to each other, and wherein the first connector and the second connector are electrically separated from each other.

12. A cooking appliance, comprising:

a cavity with a cooking space;

a socket at least partially disposed in the cooking space; and a probe detachably connected to the socket and configured to measure a temperature of the cooking space or a food item stored in the cooking space, the socket, comprising:

an insulating part configured to electrically insulate a first cable from a second cable, the insulating part having a terminal mounting groove, that is depressed;

a first connector having a hollow hole part, wherein the insulating part is disposed in a portion of the hollow hole part, and wherein a first terminal part coupled to the first cable is electrically connected to outside of the first connector, and a second terminal part coupled to the second cable is mounted onto the insulating part; and a second connector disposed in the hollow hole part, and electrically connected to the second terminal part, wherein the terminal mounting groove is provided with a rotation suppressing part, the rotation suppressing part comprises a perimeter corresponding to the depressed portions, the perimeter comprises a shape configured to suppress rotation of the second terminal part, and the second terminal part comprises a perimeter having a shape corresponding to the shape of the rotation suppressing part, wherein the insulating part comprises:

an inserting part having a hollow hole and inserted into the hollow hole part of the first connector, at least a portion of the second connector being disposed in the hollow hole part; and a terminal mounting part configured to close one side of the inserting part, the second terminal part being mounted on the terminal mounting part, the terminal mounting part comprises a pair of coupling grooves, a portion of an outer circumferential surface of each of the pair of coupling grooves is depressed, and wherein the first connector comprises a coupling projection coupled to the pair of coupling grooves.

13. The cooking appliance of claim 12, wherein the terminal mounting part comprises:

the terminal mounting groove comprising a depression, wherein the second terminal part is mounted onto the depression; and a pair of stoppers protruding from opposite sides of the terminal mounting groove and configured to suppress rotation of the second terminal part.

14. The cooking appliance of claim 3, wherein the fourth terminal comprises a surface with a substantially rectangular shape.

15. The cooking appliance of claim 3, wherein the fourth terminal comprises a surface with substantially circular shape.

16. The cooking appliance of claim 3, wherein each of the pair of stoppers comprises a surface with a substantially triangular shape.

17. The cooking appliance of claim 3, wherein each of the pair of stoppers has a substantially cylindrical shape.

18. The cooking appliance of claim 12, wherein the rotation suppressing part has a substantially rectangular shape.

19. A cooking appliance, comprising:

a cavity including a cooking space;

a socket at least partially disposed in the cooking space; and a probe detachably connected to the socket and configured to measure a temperature of the cooking space or a food item stored in the cooking space;

the socket, comprising:

an insulating part configured to electrically insulate a first cable from a second cable;

a first connector having a hollow hole part and a coupling projection for coupling one end of the first connector to the insulating part, wherein the insulating part is disposed in a portion of the hollow hole part, wherein a first terminal part coupled to the first cable is electrically connected to outside of the first connector, and wherein a second terminal part coupled to the second cable is mounted on the insulating part; and a second connector disposed in the hollow hole part and electrically connected to the second terminal part, wherein the insulating part comprises:

an inserting part having a hollow hole and inserted into the hollow hole part of the first connector, at least a portion of the second connector being disposed in the hollow hole part; and a terminal mounting part configured to close one side of the inserting part, the second terminal part being mounted on the terminal mounting part, wherein the second terminal part comprises:

a third terminal coupled to the second cable; and a fourth terminal bent from the third terminal having a first through hole, wherein the insulating part further comprises a second through hole passing through the terminal mounting part, wherein, when the fourth terminal is mounted onto the terminal mounting part, the fourth terminal is disposed at a position corresponding to the first through hole, wherein the probe comprises:

a connecting jack detachably coupled to the first connector;

a third cable comprising one end being electrically connected to the connecting jack; and a temperature measuring part electrically connected to the other end of the third cable and configured to measure a temperature of the cooking space or a food item stored in the cooking space, and wherein the second connector further comprises:

a first cell coupled to the insulating part and comprising a third through hole corresponding to the second through hole;

a second cell bent and extended from the first cell; and a third cell extended from the second cell, the third cell having a groove shape and contacting the connecting jack of the probe.

* * * * *